US012584431B2

(12) United States Patent
Bolzoni et al.

(10) Patent No.: US 12,584,431 B2
(45) Date of Patent: Mar. 24, 2026

(54) CONDITIONING SYSTEM FOR A UREA SOLUTION

(71) Applicant: ERRECINQUE S.R.L., Mappano (IT)

(72) Inventors: Matteo Bolzoni, Mappano (IT); Massimo Giachino, Mappano (IT)

(73) Assignee: ERRECINQUE S.R.L., Mappano (IT)

( * ) Notice: Subject to any disclaimer, the term of this patent is extended or adjusted under 35 U.S.C. 154(b) by 0 days.

(21) Appl. No.: 18/565,002

(22) PCT Filed: Jun. 8, 2022

(86) PCT No.: PCT/IB2022/055320
§ 371 (c)(1),
(2) Date: Nov. 28, 2023

(87) PCT Pub. No.: WO2022/259164
PCT Pub. Date: Dec. 15, 2022

(65) Prior Publication Data

US 2024/0344474 A1 Oct. 17, 2024

(30) Foreign Application Priority Data

Jun. 9, 2021 (IT) ..... 102021000015083

(51) Int. Cl.
*F01N 3/20* (2006.01)
*F01N 5/02* (2006.01)

(52) U.S. Cl.
CPC ..... *F01N 3/2006* (2013.01); *F01N 3/2046* (2013.01); *F01N 3/2066* (2013.01); (Continued)

(58) Field of Classification Search
CPC ..... F01N 2610/105; F01N 2610/10; F01N 2610/11; F01N 2610/1486; F01N 3/2006; (Continued)

(56) References Cited

U.S. PATENT DOCUMENTS

2007/0079599 A1* 4/2007 Osaku ..... F01N 3/2066 60/301
2018/0128140 A1* 5/2018 Park ..... E02F 9/0866
(Continued)

FOREIGN PATENT DOCUMENTS

DE 102007042836 B4 11/2018
DE 102019118528 A1 1/2021
(Continued)

OTHER PUBLICATIONS

International Search Report and Written Opinion from International Application No. PCT/IB2022/055320 mailed Sep. 9, 2022.

*Primary Examiner* — Atif H Chaudry
(74) *Attorney, Agent, or Firm* — Ballard Spahr LLP

(57) ABSTRACT

A management system for a urea solution for an internal combustion vehicle, comprising a tank and a management unit designed to be partially inserted in said tank to suck and enable the insertion of the urea solution, the system comprising a heating circuit comprising a first and second duct and valve means, the heating circuit being fluidly connectable through the valve means to a cooling circuit of an engine of the vehicle, the system comprising a fluid cooling circuit configured to selectively allow the passage of a refrigerant fluid inside the heat exchanger of the management unit when the heating circuit is not in operation.

12 Claims, 4 Drawing Sheets

(52) U.S. Cl.
CPC ..... *F01N 5/02* (2013.01); *F01N 2240/02* (2013.01); *F01N 2260/02* (2013.01); *F01N 2260/024* (2013.01); *F01N 2610/10* (2013.01); *F01N 2610/105* (2013.01); *F01N 2610/1473* (2013.01); *F01N 2610/148* (2013.01); *F01N 2610/1486* (2013.01); *F01N 2900/1811* (2013.01); *Y10T 137/85978* (2015.04)

(58) Field of Classification Search
CPC ..... F01N 2240/02; F01N 2900/1811; F01N 5/02; F01N 3/2046; F01N 2260/02; F01N 2260/024; F01N 3/2066
See application file for complete search history.

(56) References Cited

U.S. PATENT DOCUMENTS

| | | | | |
|---|---|---|---|---|
| 2018/0209325 | A1* | 7/2018 | Choi | E02F 9/0883 |
| 2018/0252137 | A1 | 9/2018 | Hintermeir | |

FOREIGN PATENT DOCUMENTS

| | | | | |
|---|---|---|---|---|
| EP | 1662103 | A1 | 5/2006 | |
| EP | 3330505 | A1 | 6/2018 | |
| EP | 3523520 | A1 | 8/2019 | |
| EP | 3755890 | A1 | 12/2020 | |
| FR | 2995565 | A1 * | 3/2014 | B60K 6/22 |
| GB | 2471506 | A * | 1/2011 | B60H 1/00271 |
| WO | 2011000852 | A1 | 1/2011 | |

* cited by examiner

CONDITIONING SYSTEM FOR A UREA SOLUTION

CROSS-REFERENCE TO RELATED APPLICATIONS

This Patent Application is a U.S. national stage of PCT International Application No. PCT/IB/2022/055320 filed on Jun. 8, 2022, which claims priority from Italian Patent Application No. 102021000015083 filed on Jun. 9, 2021, the entire disclosure of each of the foregoing applications is incorporated herein by reference.

TECHNICAL FIELD OF THE INVENTION

This invention relates to a conditioning system for a urea solution.

This invention finds a preferred, though not exclusive, application in conditioning urea for the use of exhaust gas after-treatment systems, in particular for work vehicles such as agricultural or earth moving vehicles.

STATE OF THE ART

To reduce diesel engine polluting emissions, it is known to use an emission lowering technique known as "selective catalytic reduction" (SCR). This technique is based on the injection of a urea-based solution into the flow of exhaust gases; this solution, via a chemical reaction, transforms the nitrogen oxides into nitrogen and water in the elementary gaseous form, significantly lowering the level of diesel engine pollutants. This urea solution, normally known by the name ADBLUE®, is normally contained in the vehicle's dedicated tank.

The urea solution is conveyed in an after-treatment system (ATS) for exhaust gases by means of a distribution circuit and, in order to control the temperature of the urea solution, is maintained at a controlled temperature by means of a conditioning circuit.

In fact, so that this reaction can occur effectively, it is known that the urea solution must have a temperature ranging between −11° and 67° C., i.e., the freezing temperature and the chemical disintegration temperature, respectively, of urea.

The tank containing the urea solution is placed outside in direct contact with atmospheric agents, especially the air and sun and, therefore, is subject to significant changes in temperature.

In order to allow the drawing of the urea solution, it is known to use suction units for the urea that are partially inserted in the tanks and connected to the cooling circuit of the vehicle engine. In this way, the suction units are configured to heat the urea solution contained in the tank itself, for example during the winter, so that the solution does not freeze, using the recirculation of the engine cooling liquid inside the suction units.

During the summer, or for situations where this tank is, for a long time, exposed to sunlight, the urea solution may heat up, exceeding the above-mentioned threshold of 67° C.

The suction units mentioned beforehand, cannot be used to cool the urea solution, which may risk, even just for a short period, exceeding the above-mentioned threshold, disintegrating and affecting its efficacy in the chemical pollution reduction process.

In addition, above the above-mentioned threshold, the urea solution tends to develop ammonia gas, which is extremely aggressive in relation to the vehicle's electronic components, making them totally unusable. In addition, this ammonia gas is toxic and may penetrate the vehicle passenger compartment, with harmful consequences for the passengers.

Examples of known cooling circuits are illustrated in EP3755890 A1, DE102007042836 B4, EP1662103 A1, EP3330505 A1, US2018252137 A1, WO2011000852 A1 or DE102019118528 A1 that, however, are not sufficiently high-performing, neither in terms of thermal exchange, nor in terms of cost. In fact, both the solutions illustrate additional thermal exchange elements placed outside or inside the tank to enable the cooling of the urea solution in addition to the heating system.

What has been described above, is even more relevant in agricultural or earth moving means, where the slow movements in the open air exacerbate the changes in temperature of the urea solution.

There is, thus, the need to keep the tank for the urea solution within a predetermined temperature range in order to prevent the chemical degradation of the urea contained inside.

The purpose of this invention is to meet the needs outlined above in an optimal and inexpensive way.

SUBJECT AND SUMMARY OF THE INVENTION

The above-mentioned purpose is achieved with a urea conditioning system as claimed in the attached claims.

BRIEF DESCRIPTION OF THE DRAWINGS

To better understand this invention a preferred embodiment is described below, by way of non-limiting example and with reference to the attached drawings, in which.

DETAILED DESCRIPTION OF PREFERRED EMBODIMENTS OF THE INVENTION

Figure 1:
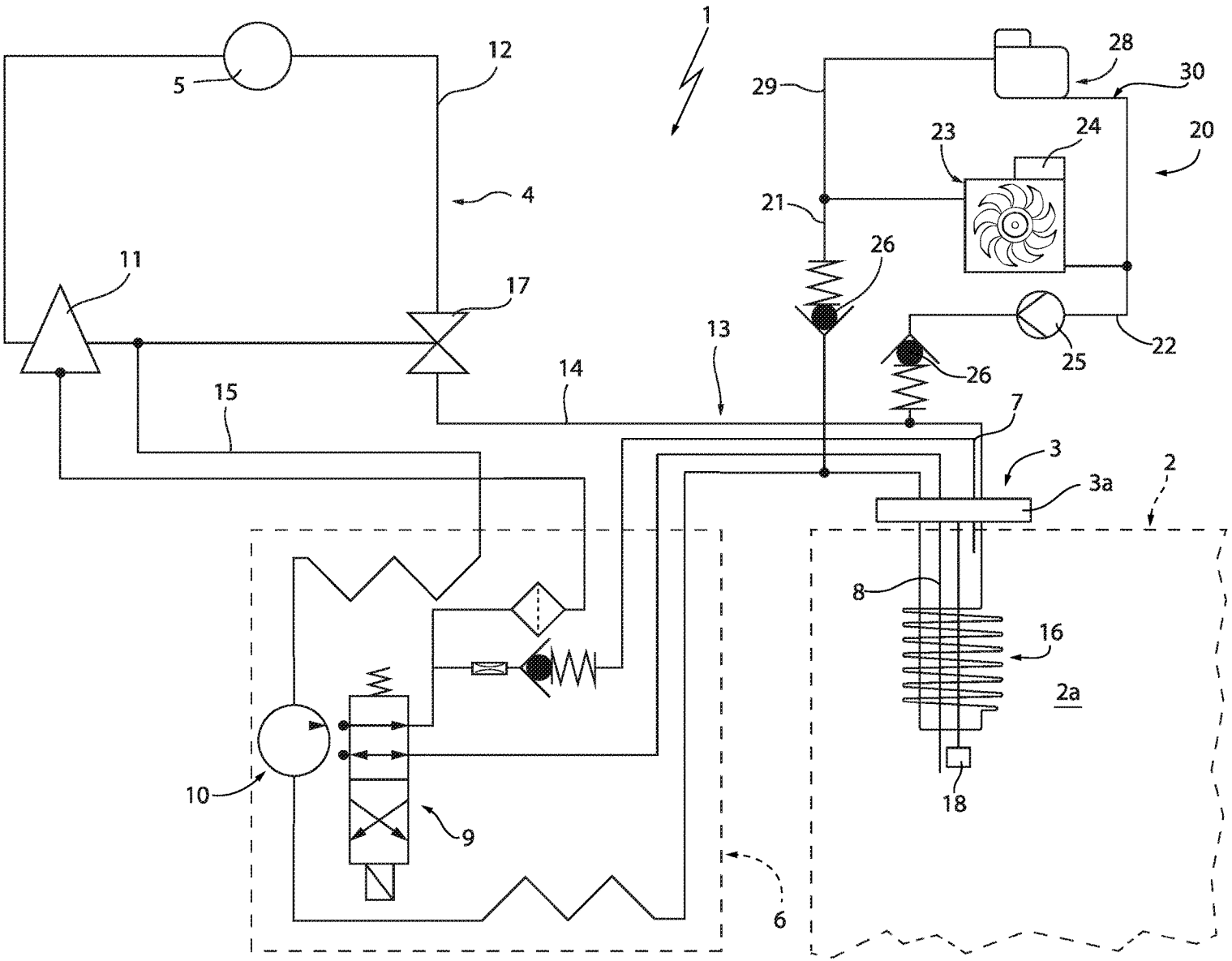
FIG. 1 is a schematic view of a conditioning system in accordance with a first embodiment of this invention.

FIG. 1 illustrates a system 1 for managing a urea solution contained inside a tank 2 carried by a vehicle (not illustrated).

In particular, the tank 2 is equipped with a urea management unit 3, also known as a sender unit, configured to be inserted in a closed space 2*a* delimited by the walls of the tank 2.

The closed space 2*a* is designed to contain a urea solution that brushes, at least in part, the management unit 3 and is equipped with a top opening through which the management unit 3 is inserted. The latter is equipped with a head 3*a* designed to be inserted, to create a seal, in the top opening and configured to enable the passage of ducts as described in more detail below.

In particular, the management unit 3 is fluidly connected to an after-treatment system for the vehicle's exhaust gases via a urea supply circuit 6.

The urea supply circuit 6 comprises a delivery duct 7 and a suction duct 8 both configured to cross the head 3*a* portion of the management unit 3 and be inserted in the space 2*a*.

Advantageously, the delivery duct 7 has a vertical extension that is smaller than the suction duct 8, in particular the latter tends to approach a bottom wall of the container 2 so as to enable the suction of the whole of the urea solution contained in the tank 2.

The delivery duct 7 and the suction duct 8 are advantageously connected to valve means 9 and to pumping means 10 configured to enable two operating conditions. In a first operating condition, the urea solution may be inserted through the delivery duct 7 inside the container 2 and, in a second operating condition, the urea solution contained in the space 2*a* may be sucked up and sent towards the after-treatment system. Since these elements are known, they will not be described in further detail.

The valve means 9 and pumping means 10 are electronically controlled by an electronic unit, not illustrated, to send the urea solution that is sucked up by the container 2 to an injection module 11 configured to inject the urea solution into an after-treatment circuit for exhaust gases.

The system 1 also comprises a fluid heating circuit 13 for the urea solution that is fluidly connected between the cooling circuit 4 of the engine 5 and the suction unit of the urea 3. In particular, the heating circuit 13 comprises a first and a second duct 14, 15 configured to be fluidly connected to a duct 12 of the cooling circuit 4 of the engine 5 and to a heat exchanger 16 placed inside the space 2*a* and immersed in the urea solution contained in the container 2.

As a result of the above, the ducts 14, 15 pass through the head 3*a*; in particular, the heating circuit 13 comprises pumping means 10 placed on one of the ducts 14, 15 and configured to circulate the fluid inside of these.

The cooling circuit 13 comprises valve means 17 configured to enable the passage of the engine 5 cooling fluid between the duct 12 of the cooling circuit 4 and the ducts 14, 15. These valve means 17 are advantageously controlled electronically by the control unit mentioned above, advantageously integrated into the management unit 3, and they may comprise, for example, a three-way valve, a two-position, ON-OFF-type valve, or a proportional valve.

The heating circuit 13 and the heat exchanger 16 may preferably be produced according to what is described in the patent application EP3523520 A1 and, therefore, are not described further for the sake of brevity.

Optionally, the management unit 3 may comprise one or more sensor means 18, of various types, configured to detect physical/chemical data of the urea solution, such as pH sensors, level sensors, temperature and pressure sensors.

The sensor means 18 are configured to send these data that are detected to the electronic control unit mentioned above. This electronic unit is advantageously carried by the management unit 3 and better integrated into the head 3*a* of the same. The control unit controls, based on these temperature data, the opening of the valve 17, as described below.

According to one aspect of the invention, there is a fluid cooling circuit 20 configured to cool the urea solution and configured to selectively enable the passage of a refrigerant fluid inside the same heat exchanger 16 used by the heating circuit 13, in particular when this is not operating.

According to the embodiment in FIG. 1, the cooling circuit 20 and the heating circuit 13 are fluidly integrated with the cooling circuit 4 of the engine 5 so as to share the same conditioning fluid.

In particular, the cooling circuit 20 comprises a first and a second duct 21, 22 fluidly connecting, respectively, the ducts 14, 15 with a heat exchanger 23.

The heat exchanger 23 is preferably a fluid-air exchanger and comprises suitable ventilation means for ensuring a flow of air designed to cool the fluid between the entry and release of the fluid inside of it.

Advantageously, the fluid cooling circuit 20 comprises fluid switching means 24, for example a thermal switch, configured to allow, or prevent, the circulation of the fluid inside the ducts 21, 22.

The fluid cooling circuit 20 also comprises pumping means 25, for example an electric pump, configured to enable the circulation of the cooling fluid between the ducts 21, 22.

The fluid cooling circuit 20 may also comprise an expansion tank 28 fluidly placed in parallel with the ventilation means 23 between the ducts 21 and 22. As a result, upstream of the ventilation means 23 there is a duct 29 that fluidly connects the duct 21 to the expansion tank 28 and downstream of the ventilation means 23 there is a duct 29 that fluidly connects the duct 21.

The duct 22 is advantageously provided with a valve 26 configured to prevent the return of the fluid towards the pumping means 25. In particular, the valve 26 is a check valve positioned so as to only enable the passage of fluid from the pumping means 25 towards the management unit 3, and not vice versa.

The duct 21 may be provided with a valve 26 configured to prevent the return of the fluid from the ventilation means 23 towards the duct 15. In particular, the valve 26 is a check valve positioned so as to only enable the passage of fluid from the duct 15 towards the ventilation means 13 (or towards the expansion tank 28), and not vice versa.

The operation of the embodiment of the system according to the invention described above is the following, referring to FIGS. 2 to 4.

Figure 2:
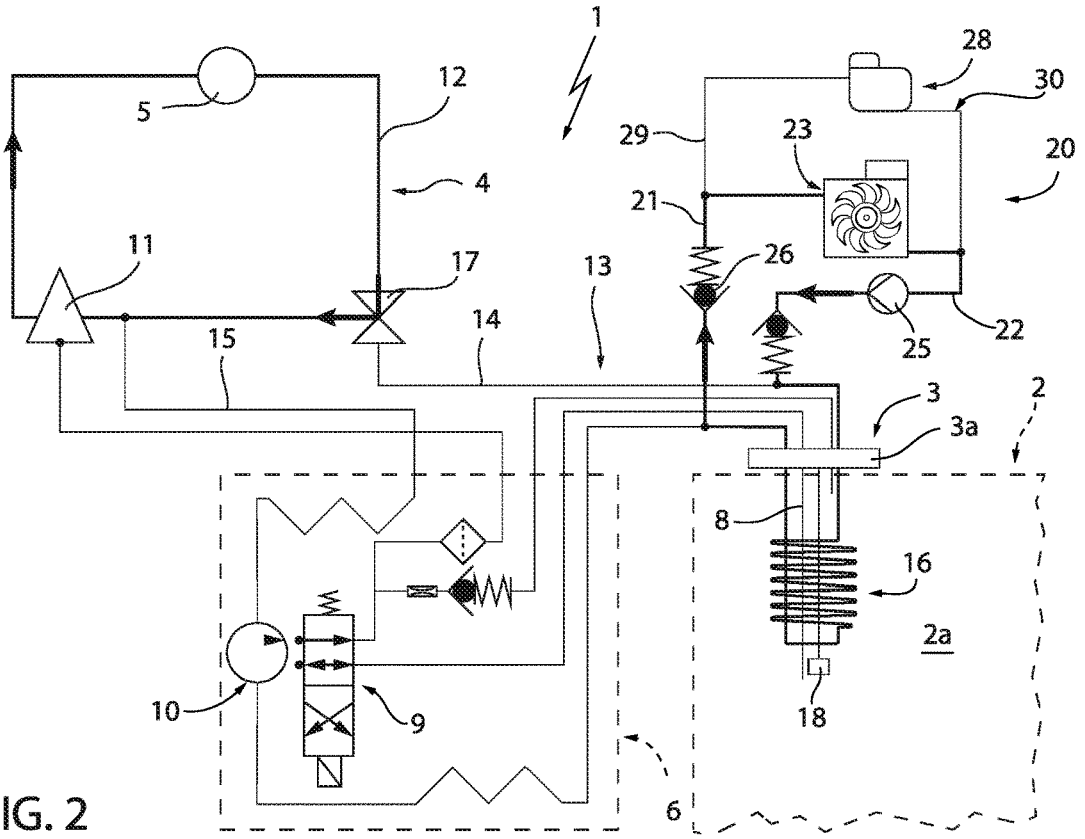
FIGS. 2 to 4, are representations of the system in FIG. 1 in different operating phases.

In a first operating condition, illustrated in FIG. 2, the temperature of the urea solution T is greater than an upper threshold temperature Ts. This detected temperature is acquired by the above-mentioned sensor means 20 and is read by the electronic unit containing electronic processing means designed to store threshold temperature values and is electrically connected to the system's electrically operable means. In this case, therefore, the electronic unit controls the pumping means 25 and the switching means 24 so that fluid circulates between the ducts 21, 22 and controls the valve 17 so that the fluid in the cooling circuit 4 of the engine 5 remains in circulation in the duct 12 without passing into the ducts 14, 15. In this way, the refrigerant fluid, advantageously ethylene glycol, flowing into the ducts 21, 22, passes into a portion of the ducts 14, 15, and, here, to the heat exchanger 16, cooling the urea solution. The refrigerant fluid, when heated, passes into the heat exchanger 23 that cools it, thanks to a flow of air, in order to be able to again remove heat from the urea solution through the exchanger 16, thanks to the recirculation provided by the pumping means 25. During this recirculation, the temperature of the urea solution is continuously monitored until its temperature goes below the upper threshold temperature Ts. In this case, the control unit shifts the system into the second operating condition.

Figure 3:
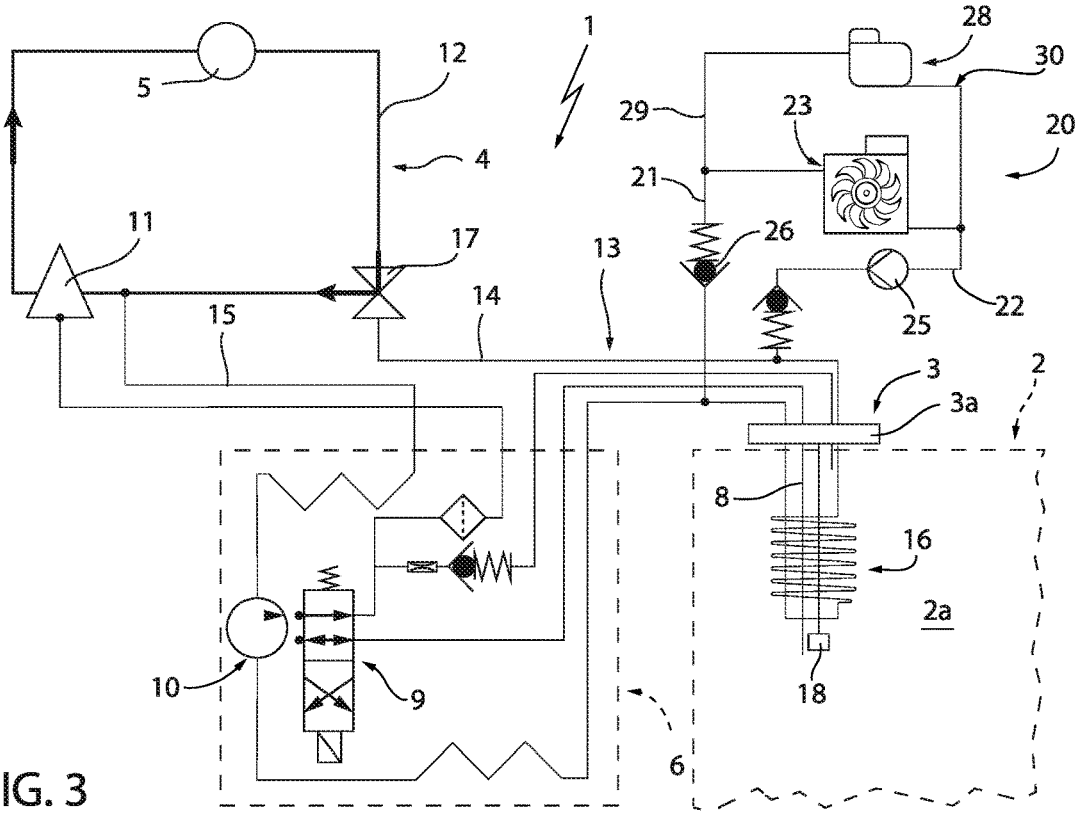

In a second operating condition, illustrated in FIG. 3, the temperature of the urea solution T is less than an upper threshold temperature Ts but greater than a lower threshold temperature Ti. In this condition, it is not necessary to change the temperature of the urea solution. Thus, the pumping means 25 do not make the fluid circulate and the valve means 17 continue to make the refrigerant fluid circulate in the sole duct 12, in order to cool the engine 5 and the injection module 11.

Figure 4:
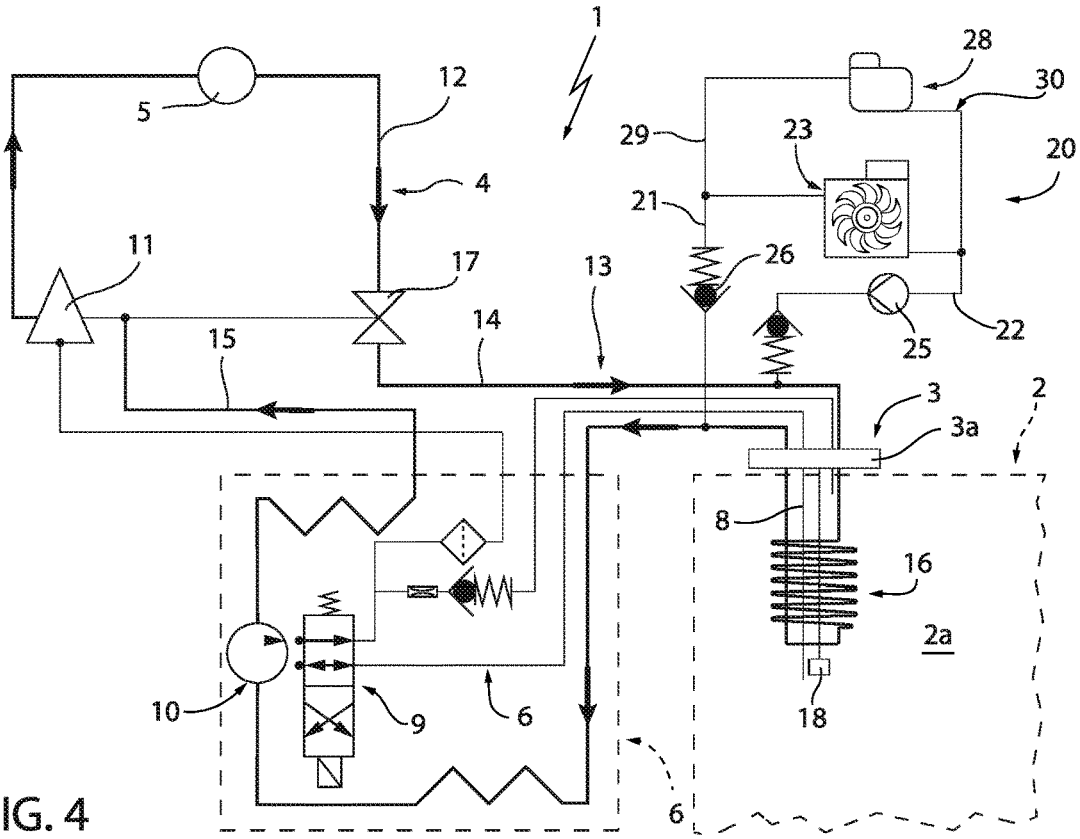

In a third operating condition, illustrated in FIG. 4, the temperature of the urea solution T is less than the lower threshold temperature Ti. In this condition, the valve means 17 enable the passage of the cooling fluid of the engine through the duct 14 towards the heat exchanger 16 and its return through the duct 15. During its passage in the heat exchanger 16, the heat from the refrigerant fluid is transferred to the urea solution that is heated. During this recirculation, the temperature of the urea solution is continuously monitored until its temperature goes above the lower threshold temperature Ti. In this case, the control unit shifts the system into the second operating condition.

Figure 5:
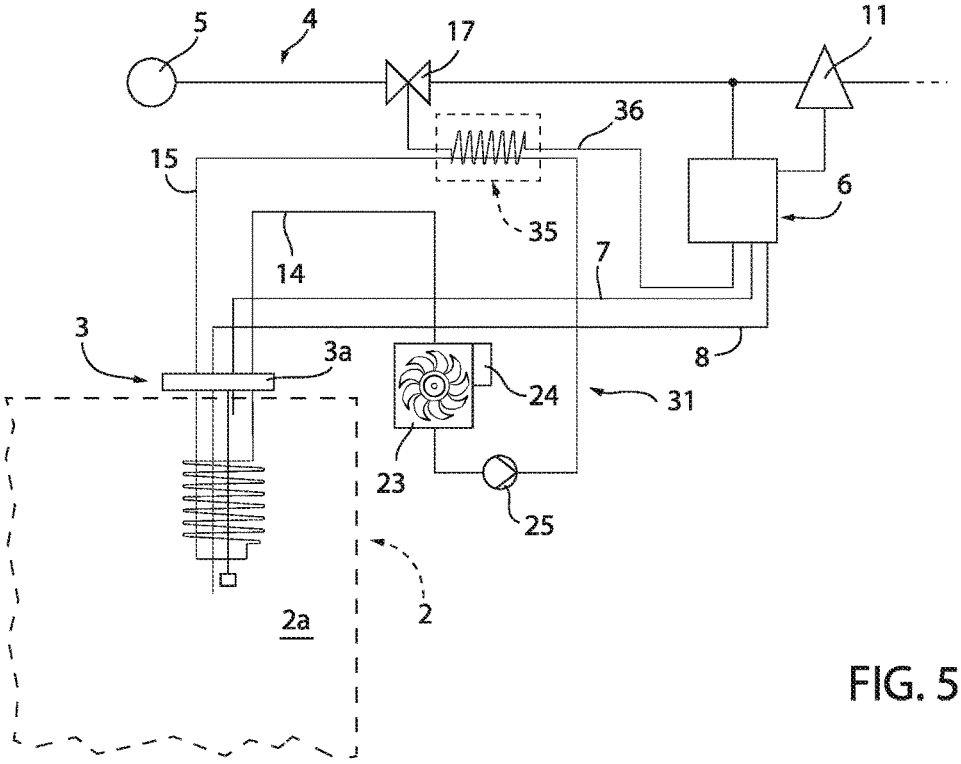
FIG. 5 is a schematic view of a conditioning system in accordance with a second embodiment of this invention.

According to a second embodiment of the invention, illustrated in FIG. 5, there is a conditioning circuit 31 that is fluidly separate to the cooling circuit 4 of the engine 5 and that carries out, at the same time, the function of cooling circuit and heating circuit through the heat exchanger 16. Potentially, it is, thus, possible to use two different conditioning fluids.

According to what is described above, the conditioning circuit 31 comprises a first duct 14 and second duct 15 that fluidly connect the heat exchanger 16 to an air exchanger 23 provided with switching means 24 similar to those of the previous embodiment.

The conditioning circuit 31 also comprises pumping means 25, for example an electric pump, configured to enable the circulation of the cooling fluid between the ducts 14, 15.

The urea management system 1 also comprises a supply circuit 6 provided with valve means 9 and pumping means 10, equivalent to those illustrated for the embodiment in FIG. 1 and not additionally described.

The urea management system 1 comprises a heat exchanger 35 configured to enable the exchange of heat between the fluid of the conditioning circuit 31 in the duct 15 and the cooling fluid 4 of the engine 5. As a result, the heat exchanger 35 is a fluid-fluid exchanger of any type.

The heat exchanger 35 is fluidly interposed along a bypass duct 36 that is fluidly connected to the cooling circuit 4 of the engine 5 via the valve means 17. The duct 36 preferably flows through the supply circuit 6 of the urea in order to heat it before its passage to the injection module 11, before hydraulically reconnecting to the duct 12 of the cooling circuit 4 upstream of the injection module 11.

The operation of the embodiment of the system according to the invention described above is the following, referring to FIGS. 6 and 7.

Figure 6:
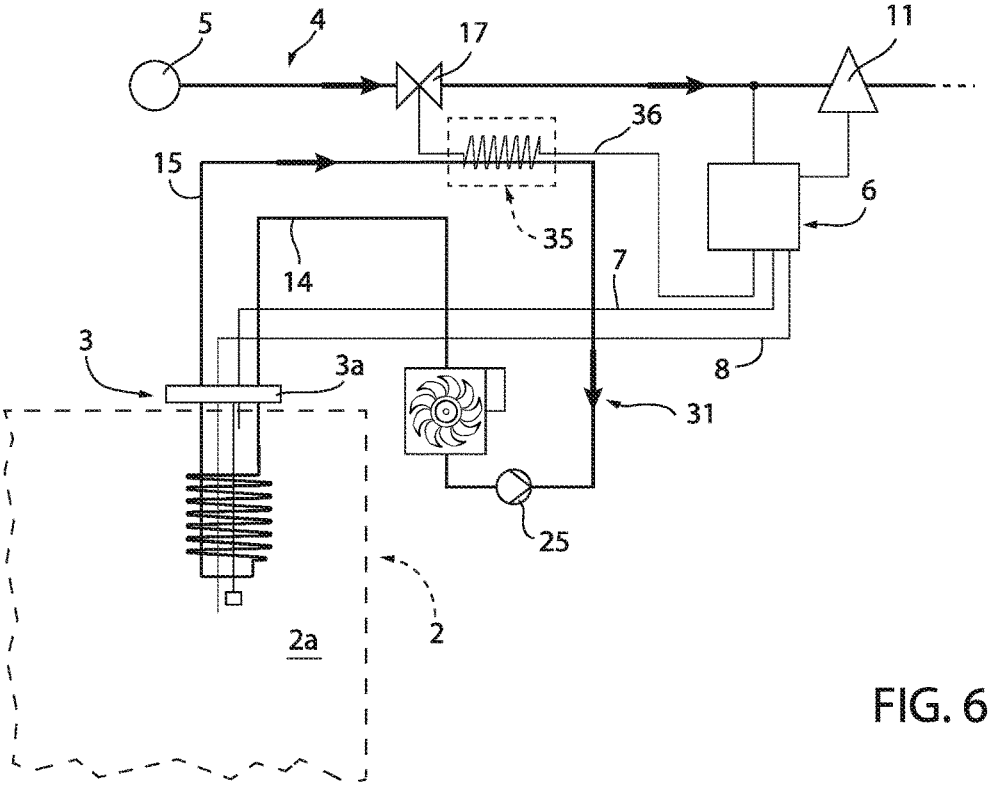
FIGS. 6 and 7, are representations of the system in FIG. 5 in different operating phases.

In a first operating condition, illustrated in FIG. 6, the temperature of the urea solution T is greater than an upper threshold temperature Ts. In this case, therefore, the electronic unit controls the pumping means 25 and the switching means 24 so that fluid circulates between the ducts 14, 15 and controls the valve 17 so that the fluid in the cooling circuit 4 of the engine 5 remains in circulation in the duct 12 without passing into the ducts 14, 15. In this way, the refrigerant fluid, advantageously ethylene glycol or any other fluid according to heat exchange or vehicle needs, flowing into the ducts 14, 15, passes to the heat exchanger 16, cooling the urea solution. The refrigerant fluid, when heated, passes into the heat exchanger 23 that cools it, thanks to a flow of air, in order to be able to again remove heat from the urea solution through the exchanger 16, thanks to the recirculation provided by the pumping means 25. During this recirculation, the temperature of the urea solution is continuously monitored until its temperature goes below the upper threshold temperature Ts. In this case, the control unit shifts the system into the second operating condition.

In a second operating condition, illustrated by FIG. 5, the temperature of the urea solution T is less than an upper threshold temperature Ts but greater than a lower threshold temperature Ti. In this condition, it is not necessary to change the temperature of the urea solution. Thus, the pumping means 25 do not make the fluid circulate and the valve means 17 continue to make the refrigerant fluid circulate in the sole duct 12, in order to cool the engine 5.

Figure 7:
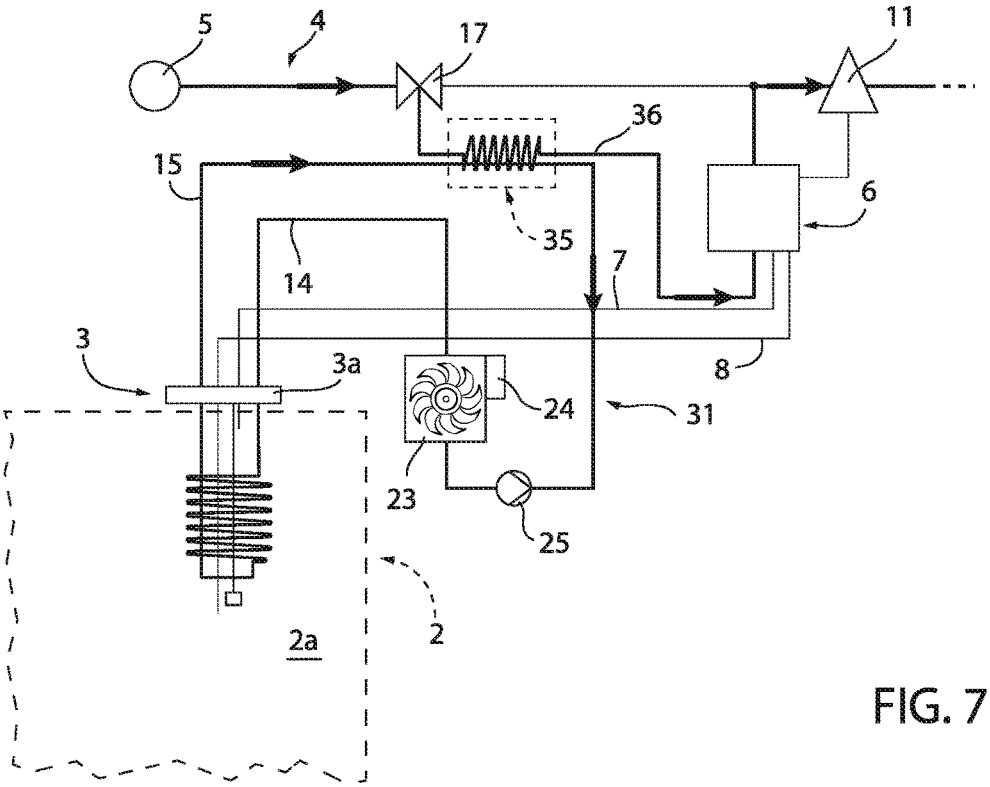

In a third operating condition, illustrated in FIG. 7, the temperature of the urea solution T is less than the lower threshold temperature Ti. In this condition, the valve means 17 enable the passage of the engine cooling fluid through the heat exchanger 35 and the pumping means 25 and the switching means 24 so that the fluid circulates between the ducts 14, 15. The duct 15, passing through the fluid heat exchanger 35, is heated by the fluid coming from the valve means 17 and, thus, proceeds towards the heat exchanger 16, transferring heat to the urea solution that is heated. During this recirculation, the temperature of the urea solution is continuously monitored until its temperature goes above the lower threshold temperature Ti. In this case, the control unit shifts the system into the second operating condition.

From the above, the advantages of a system according to the invention are clear.

Thanks to the system proposed, it is possible for the heat exchanger 16, without including additional elements, both to cool and heat the urea solution.

In fact, the heat exchanger 16, being a fluid exchanger and having a large thermal exchange surface, has a high thermal exchange capacity with the urea solution.

Thanks to the system proposed, it is possible, at the same time, to use both the same engine cooling fluid and to use other ones, depending on the vehicle and heat exchange needs.

Again, the system proposed is particularly compact and can be integrated into already existing vehicles. In particular, since the sensors and electronic unit are advantageously integrated into the suction unit, it is possible to have an extremely versatile system that is easy to maintain.

Finally, it is clear that changes may be made to the system, and variations produced thereto, according to this invention that, in any case, do not depart from the scope of protection defined by the claims.

For example, it is clear that the heat exchangers indicated, the sensor means, as well as the valve means mentioned may be of any kind, as with the pumping means.

Similarly, the hydraulic type represented is merely indicative.

The invention claimed is:

1. A management system for a urea solution for a vehicle provided with an internal combustion engine, said management system comprising:

a tank that includes at least one wall defining a space suitable for housing a urea solution, said tank provided with a management unit able to be partially inserted into said space to aspirate and allow the insertion of said urea solution;

wherein said management unit comprises a head adapted to cooperate in sealed manner with said tank and configured to allow passage of a first duct and a second duct through said head, said management unit comprising a heat exchanger, housed in said space which fluidly connects said first duct and said second duct;

a heating circuit comprising said first duct and said second duct and a first valve, said heating circuit being fluidly connectable through said first valve to an engine cooling circuit of an engine of said vehicle;

a fluid cooling circuit configured to selectively allow the passage of a refrigerant fluid inside said heat exchanger of said management unit when said heating circuit is not in operation;

a supply circuit for the urea solution, said supply circuit comprising a supply circuit pump connected to one of the first duct or the second duct between the management unit and the cooling circuit, a supply circuit valve, a delivery duct connected to the supply circuit pump and the supply circuit valve, and a suction duct connected to the supply circuit pump and the supply circuit valve, said delivery duct and said suction duct being configured to pass through said head of said management unit to enter inside said tank, wherein said fluid cooling circuit and said heating circuit are hydraulically integrated with the engine cooling circuit of said engine of said vehicle, so as to use the same conditioning fluid, wherein said fluid cooling circuit comprises an air heat exchanger fluidly connected upstream through an additional duct to said second duct and downstream through a further duct to the first duct, and a fluid cooling circuit pump configured to make a conditioning fluid flow inside said first duct, said second duct, said additional duct, said further duct, and said air heat exchanger when said heating circuit valve prevents the fluid communication of said first duct, said second duct, said additional duct, and said further duct with said engine cooling circuit.

2. The management system according to claim 1, wherein said fluid cooling circuit pump is fluidly interposed on said further duct and in which said fluid cooling circuit is provided with a fluid cooling circuit valve fluidly interposed on said further duct downstream of said fluid cooling circuit pump and configured to allow the passage of said conditioning fluid only from said fluid cooling circuit pump towards said first duct.

3. The management system according to claim 1, wherein said fluid cooling circuit comprises a fluid cooling circuit valve fluidly interposed on said additional duct upstream of said air heat exchanger, said fluid cooling circuit valve being configured to allow flow passage only from said second duct towards said air heat exchanger.

4. The management system according to claim 1, wherein said fluid cooling circuit comprises an expansion tank fluidly interposed in parallel with said air heat exchanger.

5. The management system according to claim 1, further comprising a fluid switch configured to allow or deny the passage of fluid through said air heat exchanger.

6. The management system according to claim 1, further comprising a sensor configured to detect quantities indicating the physical and/or chemical state of said urea solution and an electronic unit configured to acquire the data detected by said sensor and consequently control the operation of said first valve, of said air heat exchanger and of said fluid cooling circuit pump.

7. The management system according to claim 6, wherein said electronic unit is connected to said supply circuit and to said fluid switch and is configured to control their operation in function of the data detected by said sensor.

8. The management system according to claim 7, wherein said sensor are carried by said management unit.

9. The management system according to claim 7, wherein said electronic unit is carried by said management unit.

10. A vehicle comprising an internal combustion engine provided with a corresponding engine cooling circuit and the management system according to claim 1.

11. The management system according to claim 1, wherein the supply circuit is selectively operable in a first operating condition in which the urea solution is inserted through the delivery duct into the tank and a second operating condition in which the urea solution in the tank is sucked up through the suction duct and sent to the cooling circuit.

12. A management system for a urea solution for a vehicle provided with an internal combustion engine, said management system comprising:

a tank that includes at least one wall defining a space suitable for housing a urea solution, said tank being provided with a management unit able to be partially inserted into said space to aspirate and allow the insertion of said urea solution;

wherein said management unit comprises a head adapted to cooperate in sealed manner with said tank and configured to allow passage of a first duct and a second duct through said head, said management unit comprising a heat exchanger, housed in said space which fluidly connects said first duct and said second duct; and a conditioning system comprising said first duct and said second duct and configured to perform the function of cooling and heating said urea solution, wherein said conditioning circuit is fluidly separated from an engine cooling circuit of said engine, so as to use conditioning fluids that are fluidly separate between said engine cooling circuit and a heating circuit with respect to said engine cooling circuit of said engine, wherein said conditioning circuit comprises an air heat exchanger fluidly connected upstream through said second duct and downstream said first duct to said management unit, a pump configured to make a conditioning fluid flow inside said first duct, said second duct, and said air heat exchanger and a fluid heat exchanger fluidly interposed on said second duct and configured to exchange heat with said engine cooling circuit of said engine, wherein said fluid heat exchanger is crossed by a bypass duct configured to bleed part of the refrigerant fluid from said engine cooling circuit, said bypass duct being fluidly connected to a duct of said engine cooling circuit with a valve.

* * * * *